United States Patent [19]

Downing et al.

[11] 3,959,229

[45] May 25, 1976

[54] TEXTILE TREATMENTS

[75] Inventors: Anthony Peter Downing; Richard Llewellyn Powell, both of Runcorn, England

[73] Assignee: Imperial Chemical Industries Limited, London, England

[22] Filed: May 6, 1974

[21] Appl. No.: 467,510

[30] Foreign Application Priority Data

May 23, 1973 United Kingdom ..... 24627/73

[52] U.S. Cl. ..... 260/75 H; 260/869; 428/290; 526/242; 526/271; 526/324

[51] Int. Cl.[2] ..... C08F 8/18; C08G 63/12

[58] Field of Search ..... 260/78.5 T, 78.5 B, 260/78.4 R, 78.4 E, 75 H, 869

[56] References Cited

UNITED STATES PATENTS

| | | | |
|---|---|---|---|
| 3,451,971 | 6/1969 | Kazarus | 260/75 H |
| 3,594,353 | 7/1971 | Domba | 260/78.4 |
| 3,794,623 | 2/1974 | Kleiner et al. | 260/78.4 E |
| 3,808,244 | 4/1974 | Kleiner et al. | 260/404.5 |

FOREIGN PATENTS OR APPLICATIONS

| | | |
|---|---|---|
| 1,290,367 | 9/1972 | United Kingdom |
| 1,020,509 | 2/1966 | United Kingdom |

*Primary Examiner*—John Kight, III

*Attorney, Agent, or Firm*—Cushman, Darby & Cushman

[57] ABSTRACT

An additive for imparting soil-release or anti-soiling characteristics to a textile comprising a copolymer formed by the chemical condensation of (A) an organic compound having a plurality of carboxylic anhydride groups, and (B) a bifunctional compound, each functional group being condensible with the anhydride groups of (A) and also containing a terminal fluorocarbon group of at least 3 carbon atoms.

26 Claims, No Drawings

TEXTILE TREATMENTS

The present inventtion relates to additives for textiles.

Textile articles in use become soiled and the common form of cleaning is to wash the articles with water to which a detergent preparation has been added. It has been recognised that the washing is more effective and the soiling dirt is more readily released from the interstices between the textile fibres if a soil-release additive has been applied to the textile. The additive may have been applied when it was new or at some other convenient time during its life, for example either during or after manufacture or immediately before use in dirty conditions.

Cotton-containing textiles have been observed to present special problems in the design of or in the use of a soil-release additive because although cotton articles may be washed very clean in boiling or very hot water such harsh treatment should only be used cautiously with cotton blends or cotton-containing textiles previously treated with an easy-care additive. Easy-care additives giving for example creaseresistance, minimum iron, permanent press or anti-shrinking characteristics are in common use and either lower temperature washing cycles or gradual-temperature-lowering rinsing cycles have to be used when such additives are present.

We have now found an effective soil-release additive for use with cellulosic materials for example cotton-containing textiles including textiles made of a blend of cotton or rayon with other fibres for example synthetic fibres, especially polyester synthetic fibers, of which polyethylene terephthalate is the most important example. THe new soil-release additive we have found may be used to impart anti-soiling characteristics including soil-release on washing and anti-soil redeposition after washing, whether or not the textile fibres have been treated with another easy-care additive such as a creaseresist resin.

According to the present invention there is provided a textile additive for imparting soil-release or anti-soiling characteristics comprising a copolymer derivable by the chemical condensation of:

A. an organic compound having a plurality of carboxylic anhydride groups, and

B. a bifunctional compound condensible with the anhydride groups of (A) and containing a terminal fluorocarbon group of at least 3 carbon atoms.

According to a preferred aspect of the invention the textile additive comprises a copolymer derivable by chemical condensation of:

A. an organic compound having a plurality of carboxylic anhydride groups,

B. a bifunctional compound condensible with the anhydride groups of (A) and containing a terminal fluorocarbon group of at least 3 carbon atoms, and C. a compound containing a plurality of hydrophilic units and at least one terminal group condensible with the anhydride groups of (A).

The said terminal group of (C) is preferably a hydroxyl or a primary or secondary amino group and an alcoholic hydroxyl group is especially preferred.

The said copolymers are in fact most conveniently derived from a compound having a plurality of carboxylic anhydride groups but other ways of forming the same structure may also be used. For example an anhydride may be easily converted to the corresponding di-carboxylic acid and the use of a compound having a plurality of carboxylic acid groups to make a copolymer according to this invention, which could have been formed from the corresponding anhydride compound, is included within the foregoing statements of invention.

The compound (A) may be a monomeric compound containing two or more anhydride groups or a polymeric or oligomeric compound containing anhydride groups for example as repeating units along the polymer chain; the compound (A) may comprise a mixture of any of these anhydride compounds. A dianhydride may be used if it is desired to build up the copolymeric structure by means of the condensation of compounds (A) and (B). Alternatively it is possible to start with a polymeric compound containing a carboxylic anhydride group in each repeat unit and graft compounds (B) or (B) and (C) onto this polymeric backbone. Suitable polymeric compounds containing a plurality of anhydride groups are polymers and copolymers of maleic or itaconic anhydrides, for example copolymerised with a vinyl, vinylidene or allyl monomer, for example ethylene, propene, butene, vinyl chloride, vinylidene chloride or a vinyl ether, especially vinyl methyl ether. We especially prefer to use maleic anhydride copolymers with ethylene or methyl vinyl ether available on the market under the trade names 'Viscofas' and 'Gantrez' respectively.

Illustrative of the dianhydrides which can be used are:

pyromellitic dianhydride
2,3,6,7-naphthalene tetracarboxylic dianhydride
1,2,5,6-naphthalene tetracarboxylic dianhydride
3,3',4,4'-diphenyl tetracarboxylic dianhydride
2,2',3,3'-diphenyl tetracarboxylic dianhydride
2,2-bis(3,4-dicarboxyphenyl) propane dianhydride
2,2-bis (2,3-dicarboxyphenyl) propane dianhydride
1,1-bis(2,3-dicarboxyphenyl) ethane dianhydride
1,1-bis(3,4-dicarboxyphenyl) ethane dianhydride
bis(2,3-dicarboxyphenyl) methane dianhydride
bis(3,4-dicarboxyphenyl) methane dianhydride
(benzene-1,2,3,4-tetracarboxylic dianhydride)
bis(3,4-dicarboxyphenyl) sulfone dianhydride
bis(3,4-dicarboxyphenyl) ether dianhydride
pyrazine-2,3,5,6-tetracarboxylic dianhydride
thiophene-2,3,4,5-tetracarboxylic dianhydride and
3,4,3',4'-benzophenone tetracarboxylic dianhydride.

Of these compounds pyromellitic diannydride (PMDA) and 3,4,3',4'-benzophenone tetracarboxylic dianhydride (BTDA) are the preferred compounds.

The organic carboxylic anhydride condenses with condensible terminal groups of compounds (B) or of (C) and (B) by a conventional reaction involving the opening of the anhydride rings, the formation of for example a carboxylic ester or amide link from each anhydride and a hydroxyl or amino group respectively to provide a polyester or polyamide chain and the formation of a free carboxylic group from each condensed anhydride group. It will be appreciated that such carboxylic acid groups normally remain as branches on the polymeric chain of the copolymeric structure.

Thus a polyester or polyamide chain of low or high molecular weight may be built up by the condensation and the resulting copolymer is useful as a soil-release additive for textiles especially those containing cotton, rayon or other fibres derived from cellulose. The residual acid groups remaining from the dianhydride condensation are believed to be an important factor in the achievement of good substantivity to the cellulosic fibres as well as the dispersibility of the additive and its soil-release properties. It will be readily appreciated that textile materials are normally cleaned by washing and additives thereto are more effective and more useful if they remain in place through many washing cycles. Accordingly the substantivity of the additive to the textile is an important factor in its usefulness as a soil-release material and the substantivity of the additives of the present invention have been observed to be especially good for cotton-containing textiles.

In designing the preferred copolymeric structure for a soil-release additive according to this invention we have endeavored to obtain a balance of properties between those imparted by the incorporation of the anhydride portion (A) and those imparted by the fluorocarbon portion (B). The bifunctional molecule (B) upon condensation with the anhydride groups of (A) will be chemically-bound in the chain of the polymer having the terminal fluorocarbon groups as a side branch of the polymer chain: these groups exert their characteristic oleophobic influence and modify the properties of the copolymer. In the preferred copolymers wherein there are hydrophilic units, these help to enhance the hydrophilic character of the final copolymers; the hydrophilic units may impart ready wetting in aqueous systems whilst not impairing the olephobic influence of the fluorocarbon groups.

The terminal fluorocarbon group is preferably a perfluorocarbon group having from 3 to 14 carbon atoms and containing a terminal $CF_3$ group. Especially desirable is a perfluorocarbon group having a branched structure containing a plurality of $CF_3$ groups for example a group derived from a branched oligomer of tetrafluoroethylene or hexafluoropropene. Thus although straight-chain perfluorocarbon groups will impart to the copolymeric structure a degree of desirable properties, branched groups provide a greater degree and a more pronounced effect for the same size of groups and fluorine content. The preparation of branched fluorocarbon compounds is described in UK Pat. No. 1,366,691 and in U.K. Pat. No. 1,130,822.

The properties imparted by the fluorocarbon group are:

i. soil-repellency effect and low adhesion of dirt to the surface of the textile fibres, and ii. reduced tendency of oil and grease to soak into the textile which may be termed an 'anti-wicking' effect.

The fluorocarbon group may be incorporated by means of the preparation of a compound containing the fluorocarbon group (preferably either a straight-chain group $CF_3(CF_2)_n$ or a highly-branched group derived from branched perfluoroolefines or alcohols) joined to a diol, diamine or dicarboxylic acid as the bi-functional portion for condensation. Preferred fluorocarbon compounds include:

$R_fOC_6H_4SO_2N(CH_2CH_2OH)_2$

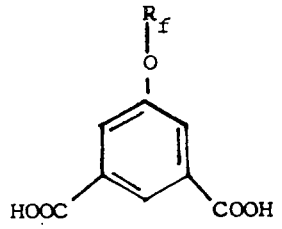

wherein $R_f = C_8F_{15}$; $C_{10}F_{19}$ or $C_{12}F_{23}$ preferably derived from oligomers of tetrafluoroethylene.

| | |
|---|---|
| $C_6F_{13}CH_2CON(CH_2CH_2OH)_2$ | wherein the $C_6F_{13}$ group is preferably the group $(C_2F_5)_2C(CF_3)$- derivable from the pentamer of tetrafluoroethylene |
| $C_8F_{17}SO_2N(CH_2CH_2OH)_2$<br>$C_7F_{15}CON(CH_2CH_2OH)_2$<br>$C_8F_{17}SO_2N(CH_2CH_2NH_2)_2$<br>$C_7F_{15}CON(CH_2CH_2NH_2)_2$<br>$(C_7F_{15}CONHCH_2CH_2NHCH_2-)_2$ | wherein the groups $C_8F_{17}$ and $C_7F_{15}$ are straight-chain, normal alkyl groups |
| $R_f'(CH_2)_3OCH_2CH(OH)CH_2OH$<br>$R_f'(CH_2)_nS(CH_2)_3OCH_2CH(OH)CH_2OH$ | wherein $R_f'$ is a straight-chain perfluoroalkyl group containing 3 to 14 carbon atoms |
| $(CF_3)_2CF(CF_2CF_2)_xCH_2CH(SCH_2CH_2OH)CH_2OH$ | where x = 0 to 5 |
| $(CF_3)_2CF(CF_2CF_2)_xCH_2CH_2CH_2CH(CH_2OH)_2$ | where x = 0 to 5 |

We especially prefer to attach the fluorocarbon to a diol for example by a reaction between a diethanol amine and a fluorocarbon acid chloride or bromide preferably a sulphonyl halide.

The fluorocarbon group may thereby be introduced into the copolymeric structure at intervals along the polymer chain which will in general be random intervals. The reagents will in general all react together when they are mixed and heated and this will normally produce a random structure. Any nonuniformity of mixing or any deliberate decision to react certain reagents prior to adding others may result in the formation of blocks of polymer structure having a nonuniform constitution. Such may be useful for the purposes of the present invention but we have not observed a preference for either type of polymer.

The hydrophilic units in (C) may themselves be terminal groups which impart hydrophilic character for example hydroxyl or amino groups additional to the one terminal group necessary for chemical combination with the anhydride group. Other hydrophilic groups for example groups which carry an ionic charge, preferably sulphate or sulphonate groups, are examples of groups which may be used as the hydrophilic units of compound (C).

Thus the compound (C) may be monomeric conveniently a polyol, for example glycerol, pentaerythritol, sorbitol or mannitol, but glycols for example ethylene glycol or propylene glycol may also be used.

However the hydrophilic units are preferably repeating units of a polymeric or oligomeric chain which may be for example a chain having repeating units of the form —$C_xH_{2x}$-R—or mixtures of these units, wherein R =—$SO_2$—, —NHCO—, or —O— and $x$ =1, 2 or 3. (When x =3 the group $C_xH_{2x}$ may be either —$(CH_2)_3$—or -$CH_2CH(CH_3)$- ).

The hydrophilic chain especially preferred is a chain of oxyethylene units.

The examples of compound C containing a hydrophilic chain as described above terminate in at least one group condensible with the anhydride groups as hereinbefore described preferably a hydroxyl group, but especially preferred is a compound terminating at both ends with a condensible (e.g. hydroxyl) group for example a polyethylene glycol.

Alternatively the examples of compound (C) containing a plurality of hydrophilic units, preferably hydroxyl groups, may be polymers having hydrophilic units as side groups of the chain for example polyvinyl alcohol, polyallyl alcohol or copolymers thereof.

The hydrophilic chain especially preferred is a chain of oxyethylene units (optionally containing also oxypropylene units) which may be an oligomeric or polymeric form of ethylene glycol terminated at each end with an alcoholic hydroxyl group: these are known as polyethylene glycols (PEG) and are classified in terms of their number average molecular weight. Thus different lengths of an ethylene glycol oligomeric chain will provide smaller or larger blocks of hydrophilic units in the copolymeric condensed structure provided by the present invention. The length of the hydrophilic chain and the proportion by weight present are variables which may be varied and adjusted to produce a greater or lesser degree of hydrophilic character in the final structure. For example hydrophilic chains from 100 to 30,000 molecular weight may be used depending on the anhydride used: with dianhydrides we prefer to use a polyethylene glycol 100–3,000 whereas with anhydride copolymers MW's of 1,000–30,000 are preferred.

When the copolymer contains two components only we prefer to condense together substantially equimolar quantities and thus the molar ratio of compounds (A) and (B) may vary from 0.5 to 2.0 but it is preferably in the range 0.75 to 1.35 in the copolymer produced.

When a compound (C) is included in addition to compounds (A) and (B) there should be sufficient of (A) present to react with (B) and (C) in order to incorporate both (B) and (C) in the copolymer. However because compound (C) may vary in structure greatly (for example from a monomeric glycol or polyol to a polymeric glycol or even a macromolecular poly alcohol) the proportion of (C) may be varied from minimal concentrations up to 90% by weight of the total. The amount of compound (C) may be chosen according to the physical properties desired for the copolymer because the hardness, solubility and hydrophilic character generally depend predominantly on the proportion of compound (C).

The overall molar proportion of compound (A) to the total molar proportion of compounds (B) and (C) together is generally within the range 0.2 to 5.0 and is preferably within the range 0.5 to 2.0.

These structures hereinbefore described are applicable as additives to a range of textiles preferably those containing cellulosic fibre but more especially useful for cotton, or blends therewith, which also have a cellulose base for example viscose rayon and cellulose ester fibres. For blends of cotton with polyester fibres (for example polyethylene terephthalate) or for textiles predominantly composed of synthetic fibres (for example nylon/wool mixtures) at least one further structural unit in the polymer is desirable. An improved additive for cotton/polyester textiles contains units of ethylene glycol terephthalate or diethylene glycol terephthalate incorporated into the polymer structure. A convenient way of incorporating these units is by means of a 'telomer' formed from the glycol and terephthalic acid the telomer containing for example a small number of units usually from two to seven and especially three or four units, of both the glycol and the acid. It is especially preferred to use a telomer which contains (M+1) units of glycol for every (m) units of acid and this terminates in hydroxyl groups which may be linked into the polymer chain by reaction with the anhydride groups of the other compound (A). The proportion of 'telomer' used may conveniently be up to 30% by weight preferably up to 15% by weight.

A preferred reaction may be represented by heating together the following reactants:

(a)

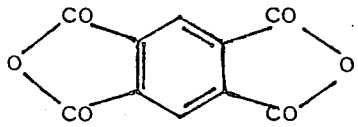

b. $HO(CH_2CH_2O)_nH$ wherein n has a mean value for 2 to 500 preferably in the range 2 to 50.

(c)

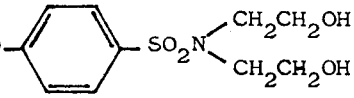

(d)

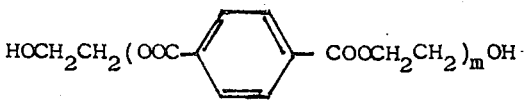

wherein m has a mean value preferably of 3.

The molar ratios of typical components which have been reacted to give useful copolymeric structures for the invention are shown in Table 1.

Table 1

| PMDA | Polyethylene Glycol (PEG) Type Mol/Wt | Quantity (moles) | TT-3 | R—<OH, OH> (moles) | Other | Quantity (moles) |
|---|---|---|---|---|---|---|
| 1 | 300 | 0.445 | 0.112 | 0.139 | | |
| 1 | 300 | 0.89 | 0.224 | 0.224 | | |
| 1 | 300 | 0.89 | 0.224 | 0.672 | | |
| 1 | 300 | 0.895 | — | 0.25 | | |

Table 1-continued

| PMDA | Polyethylene Glycol (PEG) Type Mol/Wt | Quantity (moles) | TT-3 | $R_f$—OH OH (moles) | Other | Quantity (moles) |
|---|---|---|---|---|---|---|
| 1 | 200 | 1 | 0.167 | 0.167 | | |
| 1 | 200 | 1 | — | 0.167 | | |
| 1 | 200 | 1.23 | 0.167 | 0.167 | | |
| 1 | 200 | 0.985 | 0.164 | 0.164 | | |
| 1 | 200 | 0.962 | 0.167 | 0.167 | | |
| 1 | 200 | 0.815 | 0.136 | 0.408 | | |
| 1 | 150 | 1.07 | 0.134 | 0.134 | | |
| 1 | 106 | 1.05 | 0.0916 | 0.0926 | | |
| 0.125 | 1500 | 0.0125 | 0.0125 | 0.0125 | Penta erythritol | 0.025 |
| 0.075 | 1500 | 0.0125 | 0.0125 | 0.0125 | " | 0.025 |
| 0.0125 | 1500 | 0.0125 | 0.0125 | 0.0125 | Sorbitol | 0.0166 |
| 0.075 | 1500 | 0.0125 | 0.0125 | 0.0125 | " | 0.0166 |
| 1.53 | 1500 | 1.0 | 2.5 | 0.182 | — | — |
| 3.00 | 1500 | 2.35 | — | 0.42 | — | — |

TT-3 and

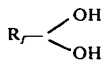

are the compounds (d) and (c) respectively shown on page 13. Alternatively the reaction may be carried out in a solvent medium preferably an inert polar solvent for example a ketone, linear or cyclic ether, sulphoxide, sulphone, amide or halogenated hydrocarbon solvent; including acetone, methyl ethyl ketone, tetrahydrofuran, dioxan, cellosolve, diglyme, dimethylformamide, dimethylsulphone, sulpholane and dimethylsulphoxide. The preferred solvents are chlorinated or fluorinated hydrocarbons for example perchloroethylene, trichloroethylene, or trichlorotrifluoroethane.

The polyester telomer (d) and the fluorocarbon diol (c) either separately or previously melted together may be added to the polyethylene glycol (b) and the temperature raised to about 180°C–210°c. The melt so produced may be stirred until uniform and then solid pyromellitic dianhydride (a) may be added gradually with continued stirring over a short-time period for example from 5 to 20 minutes. Towards the end of the addition the melt becomes very viscous but may be poured on to a tray for cooling or alternatively removed as a solid from the reaction vessel. It normally sets to a hard brittle solid which may be ground to a powder but some copolymers remain somewhat rubbery and require dissection by other methods. The solid may be dissolved in water containing sufficient alkali or organic base to give a neutral, or slightly acid, solution and applied to a cotton/polyester fabric by any of the conventional methods for applying textile finishes.

A preferred alternative procedure is to form a dispersion of the polymer in an aqueous medium. This may be effected by adding an organic liquid which has some solvent action on the copolymer and which is readily soluble in water, conveniently a glycol or glycol ether and preferably propylene glycol, to the hot melt obtained from the reacted components. A solution or partial solution is formed in the organic liquid which may be allowed to cool somewhat and then poured into an excess of water which is being vigorously agitated, for example in a high speed blender.

The quantity of copolymer additive applied on a textile fabric or yarn is for example from 0.1% to 5% preferably from 0.5% to 5% and especially from 0.8% to 3.4% by weight of additive compared with the weight of the fabric or yarn. It is advantageous to cross-link the copolymeric structure either before or after addition to the textile, but especially after the said addition. The cross-linking minimises the diffusion of the copolymeric structure into the textile; it tends to stay on the surface after application and more efficiently performs the desired function over a longer period. A cross-linked structure provides greater durability of the additive to washing or abrasion, both of which processes tend to decrease the effective life of the additive. The cross-linking may be performed by the further treatment of the copolymeric structure with a bi- or multifunctional molecule capable of reacting with the residual hydroxyl or carboxylic acid groups. A convenient molecule of this type is for example a di-epoxy compound which will react with residual carboxylic acid groups. Alternatively residual hydroxyl groups (arising from the use of a polyol containing more than two hydroxyl groups as component (C) in the condensation) may be reacted with either a diisocyanate or preferably with an excess of the same anhydride compound (A) as used for the initial condensation. When this latter preferred method of cross-linking is adopted it will be appreciated that the condensation and cross-linking reactions need not be separated: if an excess of anhydride compound (A) and a polyol such as glycerol or pentaerythritol are used the ingredients may all be reacted together in a one-stage reaction and a cross-linked structure will result.

The following procedures for application of the additive to the fabric and evaluation of soil release characteristics have been developed.

Solutions are normally prepared by weighing and hence the concentrations given below are quoted on a weight for weight basis thus avoiding the need for determining densities. If a weight volume concentration scale is used, corrections must be made if the solution densities are not unity. A typical bath recipe for fabric having an 80% 'wet expression' (i.e. pick up) of wet solution or dispersion is given below

| | |
|---|---|
| Soil release additive in aqueous propylene glycol (15% w/w) | 250 g* |
| 'Permafresh' LF (50% w/w) | 120 g* |
| $MgCl_2 6H_2O$ (catalyst for curing resin) | 25 g |
| Water to make solution to | 1 k |

*These figures are the total weights of reagents used (i.e. solids and solvents combined).

For other 'wet expressions' the bath concentration would have to be changed accordingly. The above recipe is designed to give by weight 3% soil-release additive solids and 5% Permafresh LF resins on the fabric. The liquors are stable for a minimum of 1 hour and generally for at least 12 hours under normal temperatures (i.e. around 20°C).

The prepared solutions may be applied e.g. by padding to a fabric using conventional laboratory scale or commercial scale equipment. After the wet application the fabric should be dried.

In the laboratory a circulating air oven is adequate for small test samples (e.g. 1 ft squares). On a larger scale passage through a stenter or over steam heated drums can be used. The drying temperature chosen is preferably in the range suggested for the crease-resist resin which is applied, generally 100° to 120°C for 2 minutes.

The various additives will adhere well to the fabric when they have been heat-treated subsequent to the drying stage to cure them on the fabric. The curing conditions appropriate to the crease-resist resin are used e.g. 170°C and 2 min for 'Permafresh' LF.

For the evaluation of the oil repellency of the fabric so treated we use the AATCC method, number 118–1966 described in their Technical Manual Volume 47 (1971) and the kit number test described by 3M's in British Patent 999,795.

For the evaluation of the soil-release effectiveness of the additive, we have developed the following staining procedure which gives consistent results and readily distinguishes the relative merits of various fomulations.

One drop of used engine oil (0.2 ml) is carefully placed about 1½ inches from the edge of a convenient sized specimen of treated fabric (e.g. a 9 inch square) placed on a paper tissue. It is ground in the fabric by applying moderate pressure to a 9 inch nickel spatula with a ½ inch wide flattened end, thereby producing a spot about ½ inch in diameter. Any surplus oil is removed from the fabric by careful dabbing with another paper tissue.

We consider that this method reasonably reproduces the staining process experienced by fabrics under actual wear conditions since both pressure and mechanical action are combined. Some investigators have merely applied pressure (e.g. by placing a weight over the stain)* but we consider that this is less realistic than our procedure. Used engine oil is employed because it contains fine particulate matter which is black or brown in colour and in normal wear such dark particulate matter would be significant in soil-retention during washing.

* AATCC Oil release test No. 130-1970 Test Manual Volume 47 (1971) uses only clean mineral oil.

The fabric having the small stained area is washed in a manner which may be accurately reproduced each time (a typical washing procedure is given in Example 8). After washing the intensity of stain is observed to be reduced, sometimes it becomes nearly invisible, and the stained area is cut off the large piece of fabric and retained for visual comparison with other samples. The staining, washing and cutting process is repeated for the same piece of treated fabric until a series of sample stained pieces have been assembled representing different numbers of washes. Fabrics treated with soil-release additives may be compared with untreated fabrics and a visual assessment made of the soilreleasing power of the additive after different numbers of washes in order to obtain also an assessment of the durability of the soil-release additive.

We have tested our additives in the presence and absence of a crease-resistant resin ('Permafresh' LF). Typical formulations are shown below:

| | | |
|---|---|---|
| With Resin | | |
| Soil-release additive | 3 | parts (by wt) |
| Crease-resistant resin | 7 | parts |
| $MgCl_2.6H_2O$ | 2.5 | parts |
| $H_2O$ | 87.5 | parts |
| Without Resin | | |
| Soil-release additive | 3 | parts |
| $H_2O$ | 97 | parts |

Using a 67/33 polyester/cotton test cloth and solid additions of a soil-release polymer of 1% to 3%, washing tests have been performed to attempt to remove the stain caused by dirty motor oil. The stain can be removed satisfactorily using additives herein described provided that the additive remains on the cloth. Some of the additive is lost on each wash and we have observed that the soil-release effect typically remains for 10–25 washes at 48°C.

Some tests have also been performed on 100% cotton poplin and analysis for the fluorine content of the cloth after washing indicates that the additives are substantive to cotton itself even when designed for application to polyester/cotton blends. We have also found that the additives impart soil-release properties to textiles other than those containing cotton for example nylons, acrylics, and especially cellulose ester fibres.

The soil-release additive appears to be effective in the presence of absence of crease-resistant resin. In general their durability is greater when applied with resin. Antioxidants may advantageously be added to the reaction mixture (e.g. butylated hydroxytoluene) to assist in preventing excessive discolouration of the melt during condensation and hence colouring of the cloth when the additive is applied.

The following advantageous properties are observed in use for the textile additives of the present invention:

i. stain and soil repellency
ii. antiwicking of oil-borne stains and soils
iii. soil and stain release
iv. durability on cotton and cotton blends
v. anti-soil redeposition
vii. compatibility with crease-resistant resins The invention is illustrated by the following Examples:

EXAMPLE 1

Polyethylene glycol of molecular weight 1500 (PEG 1500) (75 g, 0.05 mole), dried by azeotroping any water present with perchloroethylene (100 ml), polyethylene terephthalate telomer of number average MW 638 (TT-3) (80 g, 0.0125 mole) and fluorocarbon compound $C_{10}F_{19}OC_6H_4SO_2N(CH_2CH_2OH)_2$ (9.3 g, 0.0125 mole) were mixed and their temperature raised to 180°C with efficient stirring in an atmosphere of nitrogen. 3,4,3'4' benzophenone tetracarboxylic acid dianhydride (BTDA) (20.3 g, 0.065 mole) was added over 5 minutes and the temperature raised to 210°C for 15 minutes. On cooling a soft brown resin was obtained from which a 15% w/w solution was prepared of pH 6 by dissolving 37.5 g of the resin in 212.5 g of $H_2O$ containing 1 g NaOH. This solution was used to prepare liquors suitable for padding fabrics.

Other polymers were synthesised using BTDA having the following molar compositions:

| BTDA | PEG Type | Quantity | TT-3 | $R_f(OH)_2$ |
|---|---|---|---|---|
| 0.065 | 200 | 0.05 | 0.0125 | 0.0125 |
| 0.065 | 20M | 0.025 | 0.0125 | 0.0125 |

$R_f(OH)_2$ is the same fluorocarbon compound as in Table 1 i.e. $C_{10}F_{19}OC_6H_4SO_2N(CH_2CH_2OH)_2$.

EXAMPLE 2

To PEG 1500 (75 g, 0.05 mole) and glycerol (1.55 g, 0.0167 mole), dried by azeotroping the water with perchloroethylene, was added the fluorocarbon diol $C_{10}F_{19}OC_6H_4SO_2N(CH_2CH_2OH)_2$ (9.3 g, 0.0125 mole) and TT-3 (8.0 g, 0.0125 mole) and the mixture heated to 185°C under nitrogen, PMDA (21.8 g, 0.1 mole) was added with efficient stirring over 5 minutes and the temperature of the polymer raised to 210°–220°C at which it was maintained for 15 minutes until the viscosity of the melt had increased sufficiently to make stirring difficult. On cooling a rubbery, brown resin was obtained, 37.5 g of which were dissolved in a high-shear mixer in 212.5 g of water containing 1 g caustic soda to produce a 15% w/w solution.

Other polymers were prepared using the same method and having the following molar compositions:

| PMDA | PEG 1500 | $R_f(OH)_2$ | Glycerol | PVA | TT-3 |
|---|---|---|---|---|---|
| 0.125 | 0.05 | 0.0125 | 0.0167 | — | 0.0125 |
| 0.1 | 0.05 | 0.0125 | — | 0.1 | 0.0125 |
| 0.1 | 0.05 | 0.0125 | — | 0.05 | 0.0125 |

EXAMPLE 3

Polymers were made according to the method described in Example 1 using the molar proportion of reactant shown in Table 2. The 'Viscofas' L5 alone provided the anhydride groups in polymers I, II and III but in IV anhydride groups were provided in part by pyromellitic dianhydride.

Table 2

| Components / Polymer | 'Viscofas' L5 | PMDA | PEG 1500 | TT-3 | $C_{10}F_{19}OC_6H_4SO_2N(CH_2CH_2OH)_2$ |
|---|---|---|---|---|---|
| I | 0.20 | — | 0.05 | 0.125 | 0.125 |
| II | 0.15 | — | 0.05 | 0.125 | 0.125 |
| III | 0.125 | — | 0.05 | 0.125 | 0.125 |
| IV | 0.025 | 0.075 | 0.05 | 0.125 | 0.125 |

PMDA is pyromellitic dianhydride
'Viscofas' L5 is a copolymer of maleic anhydride and vinylmethyl ether
PEG 1500 is polyethylene glycol of average molecular weight 1500
TT-3 is $HOCH_2CH_2O[OCC_6H_4COOCH_2CH_2O]_3H$ The polymers formed were ground to a fine powder and dissolved in a slightly alkaline sample of water. Samples of white polyester cloth were treated with the polymer solution so as to depoisit a concentration of 3% by weight of the cloth after the water was evaporated. Soil-release properties imparted by the treatment were tested by the same test as described in Example 8 and all were observed to give 'acceptable' soil release up to 20 washes using a water temperature of 48°C.

EXAMPLE 4

A sample of the polyethylene glycol, PEG 1500, (75 g, 0.05 mole), was dried by removing water as an azeotrope with perchloroethylene (100 ml), and both the fluorocarbon diol $C_{10}F_{19}OC_6H_4SO_2N(CH_2CH_2OH)_2$ (9.3 g, 0.0125 mole) and polyester telomer TT-3 (8.0 g, 0.0125 mole) were added under nitrogen with efficient stirring. The temperature of the mixture was raised to 190°C and a quantity of methylvinylether/-maleic anhydride copolymer ('Viscofas' L5) (19.5 g, 0.125 mole) was added. The temperature was raised to 210°–220°C and the mixture rapidly turned deep-red in colour and become granulated in texture whereupon the mixture is cooled.

30 g of the product were dissolved in NaOH solution (170 g containing 1 g NaOH) to provide a concentrated liquor which after suitable dilution could be applied to fabrics.

EXAMPLE 5

Although the method used in Example 4 is simple it produces a deeply coloured product; the method described below using the same compounds is more involved but leads to less-coloured products.

PEG 1500 (75 g, 0.05 mole) dried with perchloroethylene (100 ml) was dissolved in acetone (100 ml) and 'Viscofas' L5 (7.8 g, 0.05 mole) added. After the solution had been refluxed for 2 hours it had turned pale and its viscosity had increased greatly. The acetone was distilled from the product and polyester telomer TT-3 (8.0 g, 0.0125 mole) and the fluorocarbon diol $C_{10}F_{19}OC_6H_4SO_2N(CH_2CH_2OH)_2$ (9.3 g, 0.0125 mole) were added. The temperature of the mixture was raised to 180°C with efficient stirring under a nitrogen atmosphere and PMDA (10.9 g, 0.05 mole) added. The reaction mixture rapidly became granular and turned orange as the temperature was raised to 200°C. After cooling a 15% w/w aqueous solution was prepared as described in example 1 for application to the fabric.

EXAMPLE 6

One cause of colouring in our products is the high temperatures (>180°C) necessary to dissolve the polyester telomer in the reaction mixture. Lower temperatures can be used if the PEG 1500 and the polyethyleneterephthalate units are derived from a copolymer of polyethylene glycol and and polyethyleneterephthalate e.g. 'Permalose' T.

To molten 'Permalose' T (75 g, 0.01875 mole) dried with perchloroethylene (100 ml) was added to the fluorocarbon diol $C_{10}F_{19}OC_6H_4SO_2N(CH_2CH_2OH)_2$ (9.3 g, 0.0125 mole) at 140°C. 'Viscofas' L5 (140 g, 0.09 mole) was added in 5 portions over 5 minutes with efficient stirring of the mixture under an inert atmosphere. The temperature was raised to 170°C over 10 minutes and held there for 10 minutes. The viscosity of the melt increased appreciably during the period of heating and on cooling a rubbery solid resulted. A 15% w/w solution was prepared as described previously.

EXAMPLE 7

An alternative procedure for producing a light-coloured material and which provides good control over the temperature of the reaction mixture is as follows:

PEG 1500 (75 g, 0.05 mole) previously dried with perchloroethylene, and 'Viscofas' L5 (3.9 g, 0.025 mole) were dissolved in acetone (100 ml) and the mixture refluxed for 2 hours. After the acetone had been removed the fluorocarbon diol $C_{10}F_{19}OC_6H_4SO_2N(CH_2CH_2OH)_2$ (9.3 g, 0.0125 mole), perchloroethylene (150 ml), polyester telomer TT-3 (8.0 g, 0.0125 mole) and PMDA (13.6 g, 0.0625 mole) were added and the mixture refluxed for 18 hours. The result was a soft uniform gel from which the perchloroethylene was removed leaving a soft polymer, 30 g of which were dissolved in 200 ml of water containing a sufficient quantity of NaOH to give a pH of ca. 11. The pH was then lowered to ca. 6 by the addition of 1 m HCl solution to give a solution which on suitable dilution could be applied to the fabric.

EXAMPLE 8

Many methods of testing for soil-release have been described in the literature, but we consider that for a stringent test the soiling agent should contain both oil and particulate matter. The two combined then provide a well-defined stained area to enable the degree of staining to be readily estimated by visual inspection. We chose dirty motor oil as our soiling agent because it is a very severe test which adequately distinguishes the more promising soil-release additives from the less promising.

The procedure for staining the textile involved spotting the corner of a square sample of fabric with 1 drop (0.2 ml) of the dirty motor oil from a height of 1 inch. After 1 minute excess oil was dabbed off with a tissue and after a further 5 minutes the sample was washed in a Hotpoint automatic washing machine using the following cycle

| | Duration | Temperature |
|---|---|---|
| Wash | 12 mins | 48° |
| Rinse | 2 mins | 20° |
| Spin | 6 mins | — |

The fabric squares were dried in a circulating air oven at 60°C before removing a small square containing the area to which the motor oil had been applied and fixing to white card with 4 spots of adhesive. The staining procedure was repeated before the second, fifth, tenth, fifteenth, twentieth washes and each time the small squares were removed in each case after washing. The specimens were rated in two ways - firstly the number of washes required to reduce the soil release characteristics of a treated sample to that of an untreated sample were noted; secondly the number of washes possible before the soil-release characteristic became less than 'acceptable'. The soil-release characterisitc was considered 'acceptable' provided only a faint, though discernible, stain remained.

A sample of white 67/33 polyester/cotton cloth was treated with additives having the compositions shown in Table 3 and the soil-release results shown in the same table were obtained using the test outlined above.

Table 3

| Molar Composition of Additives | | | | | | | |
|---|---|---|---|---|---|---|---|
| Viscofas L5 | PEG 1500 | TT-3 | Fluoro-carbon diol | PMDA | BTDA | No. of washes giving acceptable soil-release | No. of washes before soil-release disappears |
| 0.125 | 0.05 | 0.0125 | 0.0125 | — | — | 15 | 30 |
| — | 0.05 | 0.0125 | 0.0125 | — | 0.065 | 10 | 20 |
| — | 0.05 | 0.0125 | 0.0125 | 0.075 | — | 15 | 25 |
| — | 0.05 | 0.0125 | 0.0125 | — | 0.065 | 15 | 20 |

EXAMPLE 9

To molten PEG 1500 (3000 g; 2 mole) at 120°C was added $C_{10}F_{19}OC_6H_4SO_2N(CH_2CH_2OH)_2$ (270 g; 0.364 mole) in acetone (300 ml) and the latter distilled off. The temperature was raised to 160°C, and an ethylene terephthalate telomer (320 g; 0.5 mole) added. At 180°C when the mixture was homogeneous, solid PMDA (666 g 2.05 mole) was added in small portions over 10 minutes. At the end of this period the temperature had reached 193°C heating was continued until 200°C was reached and the mixture maintained there for 15 minutes. Cold propylene glycol (2600 g) was added rapidly dropping the temperature to 120°C. The mixture was stirred for one hour with sufficient heat to maintain this same temperature. The resulting pale-brown, viscous liquor was run off into cans.

(It is important to thoroughly stir the mixture throughout the course of the reaction).

An aqueous formulation containing 15% polymer solids was prepared by running the propylene glycol solution of the product (45.0 g) into water 155 g) agitated with an efficient blender to produce a stable dispersion. The latter was diluted as required and mixed with other reagents (e.g. crease-resist resins) for application to fabrics.

EXAMPLE 10

To molten PEG 1500 (1500 g; 1 mole) at 65°C in acetone (100 ml) an ethylene maleic anhydride copolymer (Monsanto EMA 31) (95 g; 0.75 mole) was added dropwise over 35 minutes with vigorous stirring. After 5 minutes reflux the acetone was distilled off over 1½ hours. When the temperature had reached 120°C $C_{10}F_{19}OC_6H_4SO_2N(CH_2CH_2OH)_2$ (135 g; 0.2 mole) in acetone (150 ml) was added, the solvent distilled and the temperature raised to 160°C. Ethylene terephthalate telomer (160 g 0.25 mole) was added and at 180°C solid PMDA (272.5 g; 1.25 mole) added in portions over 15 minutes. The resulting viscous polymer was heated to 200°C and maintained there for 15 minutes.

Propylene glycol (1250 g) was added and the mixture stirred for 1 hour before running off into storage cans.

A convenient formulation was prepared by running the propylene glycol solution of the polymer (45 g) into water (155 ml) which was agitated with a high speed blender. Although the resulting dispersion gave satisfactory results when diluted and applied to fabric the stability to settling of this and many other dispersions of like copolymers was improved by gravel milling for 60 hours. A 2 lb glass jar was ¾ filled with washed pea-sized gravel which was just covered with the aqueous dispersion of the product. The jar was sealed and rotated at 1 rev per sec on rollers for 60 hours to give a dispersion stable to settling for at least a month.

EXAMPLE 11

'Viscofas' L5 (3.9 g, 0.025 mole) was added to a solution of PEG 1500 (75.0 g, 0.05 mole) in diglyme (150 ml) and the mixture maintained at 60°C for 2 hours. Ethylene terephthalate telomer (8.0 g, 0.0125 mole) and $C_{10}F_{19}OC_6H_4SO_2N\ (CH_2CH_2OH)_2$ (9.3 g, 0.0125 mole) were added; the mixture was heated until it refluxed (ca. 170°C) and PMDA (16.5 g) added. The solution was maintained at this temperature for 16 hours. After cooling the diglyme solution was diluted with water (800 g) to produce a 15% w/w aqueous solution which when suitably diluted could be applied to fabric.

EXAMPLE 12

A solution of ethylene maleic anhydride copolymer, 'EMA 31' from Monsanto, (19 g 0.15 mole) and $C_{10}F_{19}OC_6H_4SO_2N\ (CH_2CH_2OH)_2$ (27.0 g 0.0365 mole) in acetone (250 ml) was refluxed for 2 hours. Removal of the solvent yielded a hard, yellow product which could be redissolved in acetone for subsequent application to surfaces.

EXAMPLE 13

$C_{10}F_{19}OC_6H_4SO_2N(CH_2CH_2OH)_2$ (37 gm; 0.05 M), pyromellitic dianhydride (10.9 gm, 0.05 M) and butylated hydroxy toluene (50 mg) were heated at 160°C under nitrogen with stirring for 30 minutes and then at 200°C for a further 30 minutes. On cooling, the pasty mass set to a crisp white solid which was ground to powder and dispersed in water using a highspeed blender to give a 10% w/w solids suspension. The suspension was stirred and ammonia added until the pH rose to 8–9, whereupon the material formed a milky emulsion. After dilution with water the emulsion was sprayed onto fabrics or alternatively fabrics were dipped in order to apply the additive to the textile. A typical 'add on' was 0.3% solid-additive by weight of the fabric. Carpets also were treated with the additive both by dipping the carpet into an emulsion prepared as above and by spraying the emulsion on to the surface on the carpet pile. It is not desirable to mangle the carpet as this causes flattening of the pile; excess liquor may be removed by passing the carpet over a suction slot. Application by spraying is the more convenient, and smaller volumes of liquor can be applied, but uniform penetration and distribution by the spray is difficult to achieve. Concentrations and liquor pick up may be adjusted to give 0.3% w/w solids by weight of the carpet pile after the carpet sample has been dried and heated at 100-140°C for 10–15 minutes to cure the agent.

Results

The agent was applied using spray technique to a carpet tufted with loops of nylon in a nonwoven backing, at 0.3% w/w solids 'add on', dried and cured at 130°C for 15 minutes.

This nylon carpet treated as above showed resistance to spreading of caster oil and groundnut oil, whereas an untreated carpet did not.

It is important that carpets do not pick up dry particulate soiling materials and a qualitative test to assess this property was devised.

The test for dry-soiling consists of soiling 60 1 inch felt cubes by tumbling with 12 gm sieved vacuum cleaner dust for 30 minutes and then using 2 soiled cubes to soil the 4 inch square carpet sample by tumbling together for 30 minutes.

The treated carpet showed almost no greying after this procedure whereas an untreated nylon carpet was badly stained indicating that the agent had conferred a resistance to drysoiling.

The treated and soiled carpet could be cleaned readily and completely using a proprietary carpet cleaner after the soiling teatment had been carried out several times.

What we claim is:

1. An additive for imparting soil-release or anti-soiling characteristics to a textile comprising a copolymer formed by the chemical condensation of A. an organic compound having a plurality of carboxylic anhydride groups, and B. a bifunctional compound each functional group being condensible with the anhydride groups of (A) and also containing a terminal fluorocarbon group of at least three carbon atoms.

2. The additive of Claim 1, wherein (A) is a monomeric organic compound.

3. An additive according to claim 2 wherein the copolymeric structure is formed by the condensation of (A) and (B) together with C. a compound containing a plurality of hydrophilic units and at least one terminal group condensible with the anhydride groups of (A).

4. An additive according to claim 2 wherein the compound (A) is a dianhydride of an aromatic tetracarboxylic acid.

5. An additive according to claim 3 wherein the dianhydride is pyromellitic dianhydride.

6. An additive according to claim 1 wherein the compound (A) is a copolymeric compound containing a carboxylic anhydride group in each repeat unit of the polymer.

7. An additive according to claim 6 wherein the polymeric compound is an olefine/maleic anhydride copolymer.

8. An additive according to claim 2 wherein the compound (B) is a diol.

9. An additive according to claim 2 wherein the aliphatic fluorocarbon goup is a perfluorocarbon group contaning from 3 to 14 carbon atoms.

10. An additive according to claim 9 wherein the perfluorocarbon group is a highly branched perfluoro alkenyl group.

11. An additive according to claim 3 wherein the compound (C) comprises a hydrophilic polymer chain.

12. An additive according to claim 11 wherein the compound (C) has at least two terminal groups condensible with the anhydride groups of (A).

13. An additive according to claim 12 wherein the said terminal groups are hydroxyl groups.

14. An additive according to claim 11 wherein the polymer chain comprises oxyethylene units.

15. An additive according to claim 13 wherein the compound (C) is a polyethylene glycol.

16. An additive according to claim 11 which also contans polymerised units of a glycol terephthalate.

17. An additive according to claim 16 wherein the polymerised units are those of ehtylene glycol terephthalate.

18. An additive according to claim 17 wherein the polymerised units of ehtylene glycol terephthalate are introduced into the additive by means of a telomer which is a condensate of *m* molecules of acid and *m*+1 molecules of glycol where *m* is from 2 to 7.

19. The additive of claim 11, wherein the copolymeric structure is derivable by condensation of (A), (B) and (C) together with (D), wherein A. is a monomeric aromatic carboxylic dianhydride;

B. is a fluorocarbon diol $C_{10}F_{19}OC_6H_4SO_2N(CH_2CH_2OH)_2$;

C. is a polyethylene glycol; and

D. is a polyethylene terephthalate telomer.

20. The additive of claim 19, wherein (A) is pyromellitic dianhydride or benzophenone tetracarboxylic dianhydride and wherein (D) has the formula $HOCH_2CH_2O(OCC_6H_4COOCH_2CH_2O)_3H$.

21. A textile material with an additive as claimed in claim 11.

22. A polyester/cotton textile material treated with an additive as in claim 20.

23. A process for the production of a textile additive of claim 2 comprising the chemical condensation of compounds (A) and (B).

24. A process comprising the condensation of compounds (A) and (B) of a compound (C) in accordance with claim 19.

25. A process as claimed in either claim 23 wherein the copolymeric product of the chemical condensation is added whilst still hot to an organic liquid which is readily soluble in water and which has some solvent action on the copolymer.

26. A process as claimed in claim 25 wherein the organic liquid is propylene glycol.

* * * * *